United States Patent [19]

Hayakawa

[11] Patent Number: 4,984,914

[45] Date of Patent: Jan. 15, 1991

[54] MULTI-TASK PRINTER

[76] Inventor: Tpshio Hayakawa, 3717 Cardiff, No. 101, Los Angeles, Calif. 90034

[21] Appl. No.: 377,174

[22] Filed: Jul. 10, 1989

Related U.S. Application Data

[63] Continuation-in-part of Ser. No. 174,140, Mar. 28, 1988, abandoned.

[51] Int. Cl.[5] ..... B41J 11/50; B41J 15/18

[52] U.S. Cl. ..... 400/585; 400/585.1; 400/608.2; 226/108; 226/115; 226/188

[58] Field of Search ..... 400/608.2, 585, 585.1, 400/641, 611, 616, 607.3; 226/108–109, 111, 115, 188, 189, 196

[56] References Cited

U.S. PATENT DOCUMENTS

| | | | |
|---|---|---|---|
| 2,047,233 | 7/1936 | Sherman | 400/608.2 |
| 2,107,398 | 2/1938 | Smith | 400/607.1 |
| 2,213,552 | 9/1940 | Scharr | 400/585.1 |
| 2,326,291 | 8/1943 | Dodge et al. | 400/608.2 |
| 2,348,059 | 5/1944 | Daly | 400/583.2 |
| 2,555,732 | 6/1951 | Dayger et al. | 400/583 |
| 2,862,708 | 12/1958 | Allen | 400/605 |
| 3,176,819 | 4/1965 | Bloom, Jr. et al. | 400/605 |
| 3,653,483 | 4/1972 | Corona | 400/613 |
| 3,847,261 | 11/1974 | Matsuhisa | 400/585.1 |
| 3,850,355 | 11/1974 | Downie et al. | 400/608.2 |
| 3,932,842 | 1/1976 | Kewnavane | 400/585.1 |
| 4,027,765 | 6/1977 | Caump et al. | 400/584 |
| 4,074,797 | 2/1978 | Lewis et al. | 226/108 |
| 4,229,113 | 10/1980 | Anderson et al. | 226/196 |
| 4,348,125 | 9/1982 | Fujiwara et al. | 226/115 |
| 4,382,704 | 5/1983 | Henrischk | 400/585.1 |
| 4,395,152 | 7/1983 | Hendrischk | 400/585 |
| 4,417,825 | 11/1983 | Cushman et al. | 400/608.2 |
| 4,832,244 | 5/1989 | Moriya | 226/115 |

FOREIGN PATENT DOCUMENTS

| | | | |
|---|---|---|---|
| 3014609 | 12/1982 | Fed. Rep. of Germany | 400/608.2 |

*Primary Examiner*—Eugene H. Eickholt
*Attorney, Agent, or Firm*—Cislo & Thomas

[57] ABSTRACT

A feeding device for computer printers and the like comprising two platens each provided with respective pairs of drive sprockets and rotatably mounted on a common drive shaft, together with clutch means for selectably connecting said drive shaft to rotate said platens.

2 Claims, 1 Drawing Sheet

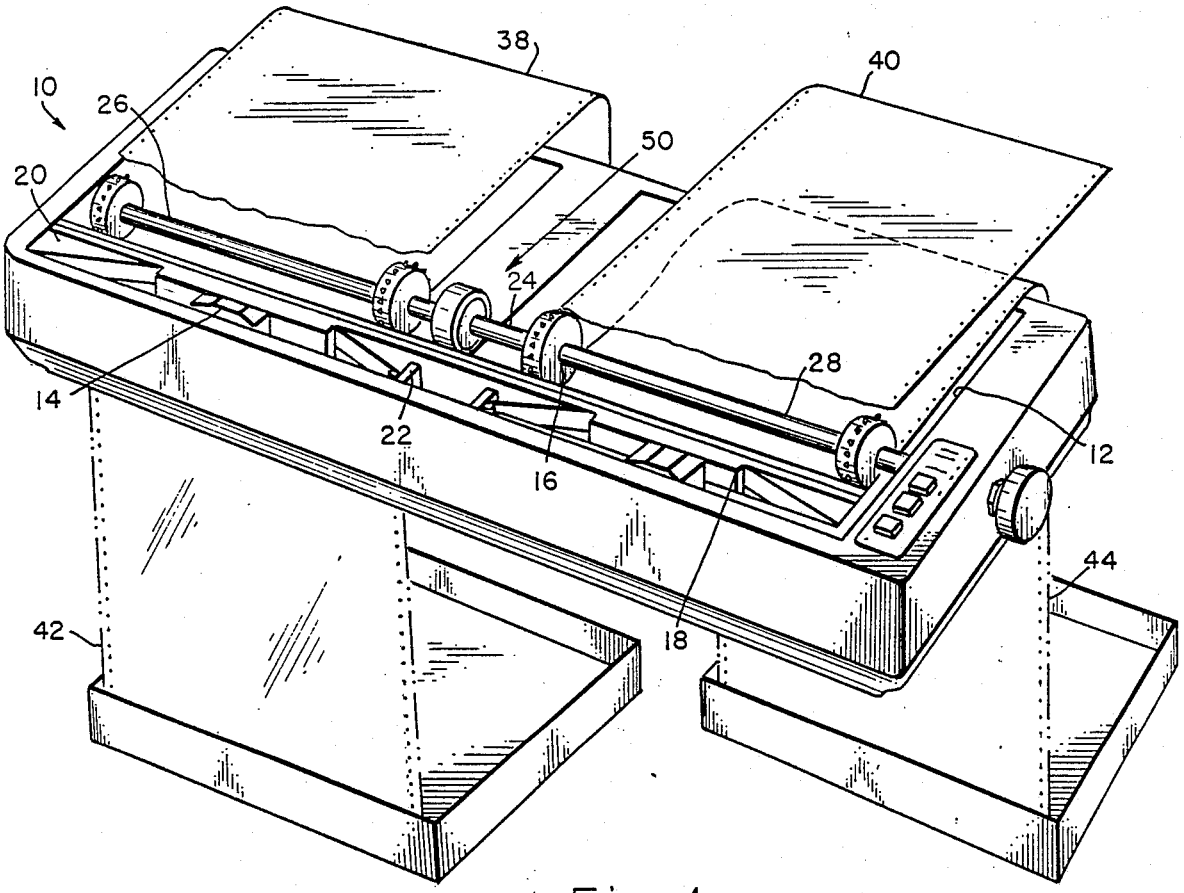
Fig. 1.
Fig. 2.
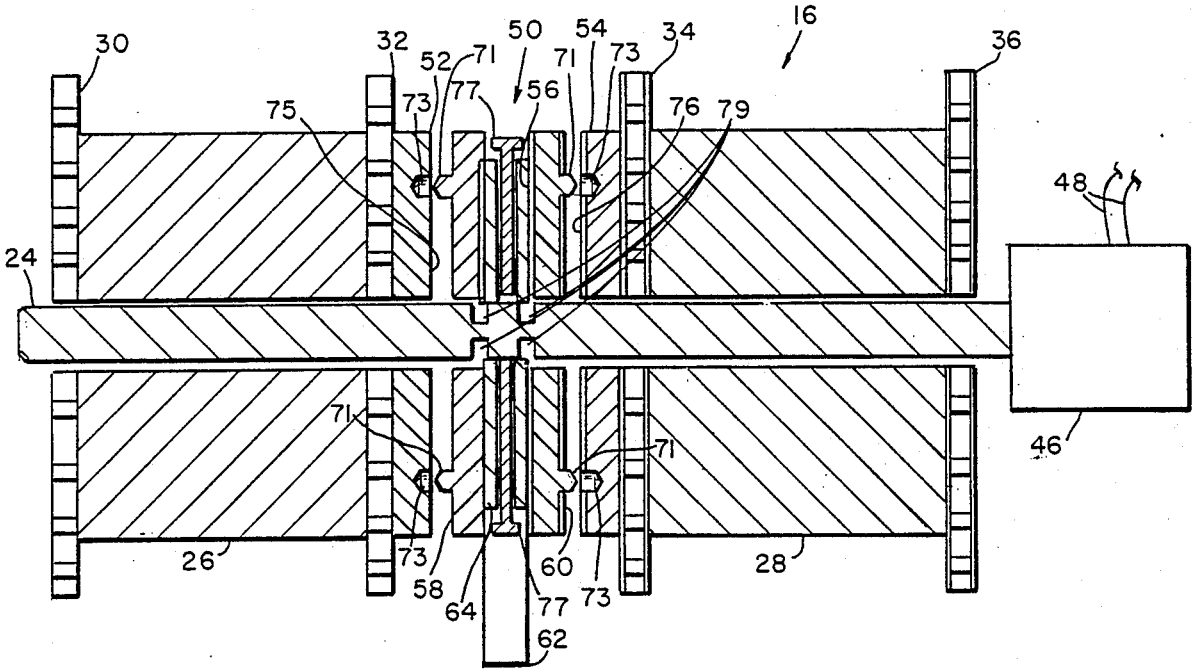

MULTI-TASK PRINTER

This application is a continuation-in-part application of U.S. Application Ser. No. 07/174,140 filed on Mar. 28, 1988, now abandoned.

BACKGROUND OF THE INVENTION

This invention relates to printing devices and is particularly directed to printing devices for use with computers and the like which printing devices are capable of performing multiple tasks.

It is common practice today, in many businesses, to maintain inventory, purchase order and billing information on a computer and to use a printer, controlled by the computer, to prepare invoices and address labels. Since the customer's name and address usually appear on the invoice, as well as the address label, it would be convenient to print both of these items substantially simultaneously. However, the invoice forms must contain considerable additional information and, hence, must be much larger than the address labels and the invoice forms must be fed to the printer with a much different advance pattern than the address labels.

It is possible to obtain combination forms which include both the invoice form and the address label, but these combination forms are quite expensive. Thus, it has been necessary, heretofore, to run the invoice forms and the address labels separately which requires additional time and manpower. For small businesses, especially the need to minimize costs is a matter of survival and any device which will facilitate this is greatly needed. In attempting to meet this need, there have been previous proposals for dual-delivery apparatus which would feed both types of forms to the printer. However, none of the prior art devices have been entirely satisfactory. A search in the U.S. Patent Office located the following:

| U.S. Pat. No. | Inventor | Issued |
|---|---|---|
| 2,107,398 | J. A. B. Smith | Feb. 8, 1938 |
| 2,213,552 | W. P. Scharr | Sept. 3, 1940 |
| 2,348,059 | G. F. Daly | May 2, 1944 |
| 2,555,732 | J. E. Dayger et al | June 5, 1951 |
| 2,862,708 | P. M. Allen | Dec. 2, 1958 |
| 3,176,819 | E. M. Bloom, Jr. et al | April 6, 1965 |
| 4,027,765 | L. L. Crump et al | June 7, 1977 |
| 4,074,797 | E. R. Lewis et al | Feb. 21, 1978 |
| 4,229,113 | T. H. Anderson et al | Oct. 21, 1980 |
| 4,348,125 | T. Fujiwara et al | Sept. 7, 1982 |
| 4,382,704 | W. Henrischk | May 10, 1983 |
| 4,403,878 | H. Hosogaya | Sept. 13, 1983 |
| 4,439,051 | R. L. Lawter | Mar. 27, 1984 |

The patent to Scharr teaches the use of a platen which is divided into two sections which may be driven either separately or simultaneously to permit feeding either one wide document or two smaller width documents which may be advanced together or independently. However, this adds considerable cost and complexity to the system. Furthermore, the need for Scharr to accommodate wide forms precludes the use of drive sprockets on the adjacent edges of the two platen sections. This tends to cause uneven advancement of the small forms driven by the two platen sections and is likely to cause jamming of the machine and tearing or crumpling of the forms.

The patent to Hosogaya discises a printer feeding mechanism for feeding two separate forms but provides that the two may be advanced either in unison or at various rates. Again, this introduces cônsiderable cost and complexity to the system.

The patent to Allen teaches apparatus for feeding two strips of forms to a printing machine in which both form strips are advanced simultaneously during one portion of the printing operation, and are advanced independently during other portions of the printing operation. In order to accomplish this, it is necessary for Allen to include a transmission for controlling the drive mechanism and this greatly increases the cost and complexity of the system.

The patents to Anderson and Hendrischk are directed to ancillary devices, such as roll end detectors, while the patents to Bloom, Crump, Lewis and Lawter relate to devices which are clearly much more complicated and expensive than the present invention.

In the examination of the parent application, the following references were cited:

| Pat. No. | Inventor | Issued |
|---|---|---|
| 2,047,233 | J. Q. Sherman | July 14, 1936 |
| 2,326,291 | E. S. Doldge et al | Aug. 10, 1943 |
| 3,850,355 | J. Downie et al | Nov. 26, 1974 |
| 4,417,825 | J. E. Cushman et al | Nov. 29, 1983 |
| DE 30 14 609 41 | Mannesmann AG | April 14, 1980 |

The Sherman reference discloses a conventional typewriter mechanism having a multi-sectional platen. The platen is fixedly held but rotatable within a reciprocatory platen carriage, requiring a traveling carrier for the stationary supply. However, there is no means to selectively couple one or the other of the platen sections by an electrically operated clutch system. Further, the only manual adjustable stop is by means of the margin set and margin release functions of the conventional typewriter, which can only be entered through the keyboard and not controlled by a computer.

The Downie, et al reference is directed to a multisectional form feed device, which can function as a split platen. The system makes use of a plurality of pressure roll assemblies, as opposed to multiple pin feed assemblies, driven by a stepper motor. The stepper motor is provided with two mechanicallv operated unidirectional clutch assemblies. Thus, selection of which form is to be advanced can be accomplished electrically by operating the motor in a counter-clockwise direction the required number of rotational steps, or manually by manual rotation of its cam shaft. However, to electrically advance the cam shaft to select which forms to be spaced by its drive roller, the motor must reverse direction subsequent to driving the cam shaft in order to advance the paper Having rotated counter-clockwise a specified number of steps in order to position the cam shaft, the motor must then subsequently rotate clockwise in order to drive the roller to advance the selected form a predetermined number of steps. Because a stepper motor is utilized, the position of the cam shaft must be encoded to provide automatic selection of the proper cam shaft position, and since the motor must rotate a specific number of steps from its previous position a counter or counters must be utilized in the circuitry to monitor motor position.

The Downie et al reference fails to disclose a drive system for a split platen having a clutch to selectively connect a desired one of the two platens responsive to (1) a control signal from a computer and (2) a manual displacement handle member of the clutch assembly.

The other references cited were directed to typewriter-type mechanisms for moving paper.

OBJECTS AND SUMMARY OF THE INVENTION

These disadvantages of the prior art are overcome with the present invention and feeding mechanism is provided which permits two form strips to be fed to a printer independently, yet which is extremely simple and inexpensive to produce, purchase and maintain.

The advantage of the present invention are preferably attained by providing a feeding device comprising two platens each provided with respective pairs of drive sprockets and rotatably mounted on a common drive shaft, together with clutch means for selectably connecting said drive shaft to rotate said platens. The clutch may be actuated either manually or electrically and, hence, can be controlled either by the operator or by commands from the computer controlling the printer Similarly, the print head can be positioned, either manually or electronically, to starting positions for printing on either of said platens.

Accordingly, it is an object of the present invention to provide improved feeding apparatus for computer printers and the like.

Another object of the present invention is to provide feeding apparatus for computer printers and the like which will permit independent advancement of two different form strips.

An additional object of the present invention is to provide feeding apparatus for computer printers and the like which permits independent advancement of two different form strips, yet which is simple and economical to produce, purchase and maintain.

A specific object of the present invention is to provide a feeding device for computer printers and the like comprising two platens each provided with respective pairs of drive sprockets and rotatably mounted on a common drive shaft, together with clutch means for selectably connecting said drive shaft to rotate said platens.

BRIEF DESCRIPTION OF THE DRAWINGS

FIG. 1 is a diagrammatic representation of a printing device embodying the present invention; and FIG. 2 is a front elevation, partly in section, showing the feeding mechanism of the printer of FIG. 1.

DETAILED DESCRIPTION OF THE INVENTION

In that form of the present invention chosen for purposes of illustration in the drawing, FIG. 1 shows a printer, indicated generally at 10, having an opening 12 extending therethrough which houses a printing head 14 and a double form feeding mechanism embodying the present invention, indicated generally at 16. The printing head 14 is slideably mounted on a printer shaft 18 which extends transversely across the opening 12 of the printer 10. Initial positioning of the printing head 14 can be accomplished either manually or electronically under the control of a computer, as is conventional in the art. However, the shaft 18 is provided with a permanent stop 20, located adjacent to the left end of the shaft 18, and a releasable stop 22 located approximately at the middle of the shaft 18.

The releasable stop 22 can be actuated either manually or electronically by a command from the computer and serves to provide an initiating position for printing of forms on the right hand side of the printer 10. When stop 22 is released, the printing head 14 can be moved to the left end of the shaft 18 to provide an initiating position for printing forms on the left hand side of the printer 10.

As best seen in FIG. 2, the double form feeding mechanism 16 comprises a shaft 24 extending transversely across the opening 12 of the printer 10 and has a pair of platens 26 30 and 28 rotatably mounted on the shaft 26. Each of the platens 26 and 28 occupies approximately one-half the length of the shaft 24 and is flanked by a pair of sprocket members 30, 32, 34 and 36 which are secured for rotation with the respective one of the platens 26 or 28 and serve to advance the form strip carried by the respective platen 26 or 28. Each of the platens 26 and 28 serves to feed a respective form strip, as seen at 38 and 40 in FIG. 1. Moreover, the form strips being driven by the platens 26 and 28 may be bottom-fed, as seen in phantom at 42 in FIG. 1, or may be fed from the rear, as seen in phantom at 44 in FIG. 1. In order to advance the form strips 38 and 40, the shaft 24 is rotated by a suitable motor 46, controlled by the computer through conductors 48, and is coupled to drive a desired one of the platens 26 or 28 through a suitable clutch mechanism, indicated generally at 50. As best seen in FIG. 2, the adjacent sprockets 32 and 34 of the respective platens 26 and 28 each carries a clutch plate 52 and 54, while a clutch actuating member 56 is mounted for rotation with the shaft 24 and carries clutch faces 58 and 60 which are selectably engageable with the adjacent one of the clutch plates 52 or 54 to transmit the motion of the shaft 24 to the corresponding one of the platens 26 or 28. The clutch actuating member 56 may be caused to engage a desired one of the clutch plates 52 or 54 manually, by means of handle 62, or electronically by solenoid 64 which may be controlled by signals from the computer.

In use, the form strips 38 and 40 are each threaded into the printer 10 on a respective one of the platens 26 or 28, as seen in FIG. 1, and the printing head 14 is caused to engage a desired one of the stops 20 or 22. Thereafter, the printer 10 is turned "ON" to cause motor 46 to rotate shaft 24. Since the platens 26 and 28 are rotatably mounted on the shaft 24, the platens 26 and 28 will simply "idle" until the clutch actuating mechanism 56 is moved to engage one of the clutch faces 58 or 60 with a selected one of the clutch plates 52 or 54. The selected one of the form strips 38 or 40 will then be advanced in accordance with commands from the computer supplied to motor 46 through conductors 48. As desired, the computer may also send commands to the clutch actuating mechanism 56 to discontinue feeding the previously selected one of the form strips 38 or 40 and to begin advancement of the other. At the same time, the computer will supply commands to cause the printing head 14 to engage the appropriate one of the stops 20 or 22 on the printer shaft 18 to prepare for printing the alternative one of the form strips 38 or 40. Obviously, such switching can be accomplished substantially instantaneously and as often as desired. Moreover, although the platens 26 and 28 have been shown as being substantially equal in length, it will be apparent that other sizes of platens could easily be substituted for that shown.

The clutch faces 58 and 60 can define on their surface protrusions 71 which engage indentations 73 or the exterior surfaces 75 and 76 of the clutch plates 52 and 54, respectively. Pins 77 can be inwardly biased so as to engage holes 79 defined within the shaft 24 when properly aligned, yet can be held and extended away from the clutch assembly 50. The holes are positioned so that when the clutch assembly 50 is moved left or right by the solenoid 64, the pins 77 engage the holes 79 to sufficiently engage the clutch mechanism 50 with the shaft 24 to impart rotational force to either clutch plates 52 or 54 and respective movement thereby The pins 77 can also be operatively associated by mechanical armatures (not shown) with the solenoid 64 so that the pins are biasedly retracted prior to the solenoid 64 moving the clutch mechanism 50 either right or left. Many other types of clutch mechanisms can be incorporated other than the one herein discussed which is known to persons ordinarily skilled in the art. Frictional engagement in addition to the mechanical engagement as shown in FIG. 2 is one such approach between the clutch faces 58 and 60 and the clutch plates 52 and 54, respectively.

In addition, numerous other variations and modifications may be made without departing from the present invention. Accordingly, it should be clearly understood that the form of the present invention described above and shown in the accompanying drawings is illustrative only and is not intended to limit the scope of the present invention.

I claim:

1. A printing device operable by a computer and comprising:

a housing formed with an opening extending therethrough, a printer shaft fixedly held, but allowed to rotate extending transversely across said opening, a print head mounted on said printer shaft and movable along said shaft under the control of said computer, a permanent stop located adjacent to a left end of said printer shaft to limit leftward movement of said print head, said print head being displaceable against a selected one of said stops by means of either computer control or manual displacement thereof; and a longitudinally stationary feeding device for selectively feeding a pair of form strips to said print head and having a drive shaft extending transversely across said opening adjacent to said print head, a motor for rotating said drive shaft under the control of said computer, two platens restricted to rotational movement on said drive shaft each provided with respective pairs of drive sprockets restricted to rotational movement, and clutch means for selectively connecting said drive shaft to rotate a desired one of said platens, said clutch means being selectively operable responsive to (1) a control signal from said computer and (2) a manual displacement of a handle member of said clutch means, and wherein said drive sprockets pull said form strips around said platens.

2. A feeding device for computer printers and like comprising:

Two platens mounted on a common drive shaft and restricted to rotational movement, and each provided with respective pairs of drive sprockets, and clutch means for selectively connecting said drive shaft to rotate a selected one of said platens, said clutch means including (1) solenoid means for electrically selecting one of said platens for coupling to said drive shaft, and (2) a handle member for manually selecting one of the said platens for coupling to said drive shaft, further comprising a stationary means for feeding a plurality of forms into the printer, and wherein said common drive shaft is fixedly held stationary, but allowed to rotate, and wherein said drive sprockets pull said forms around said platens.

* * * * *